United States Patent [19]

Liljegren

[11] Patent Number: 4,976,079

[45] Date of Patent: Dec. 11, 1990

[54] BUILDING STRUCTURE HAVING STACKED WOODEN BEAM WALLS

[76] Inventor: Said D. Liljegren, Route 631, Leon, Va. 22725

[21] Appl. No.: 273,374

[22] Filed: Nov. 18, 1988

[51] Int. Cl.[5] ..... E04B 1/10

[52] U.S. Cl. ..... 52/233; 52/561

[58] Field of Search ..... 52/233, 561, 566, 568

[56] References Cited

U.S. PATENT DOCUMENTS

| | | | |
|---|---|---|---|
| 157,399 | 12/1874 | Holmes . | |
| 760,974 | 5/1904 | Dyarman et al. . | |
| 791,405 | 5/1905 | Crandal . | |
| 2,387,659 | 10/1945 | Hafsos . | |
| 2,550,883 | 5/1951 | Vincent | 52/233 |
| 2,723,107 | 11/1955 | Parker . | |
| 3,380,769 | 4/1968 | Piget . | |
| 4,115,969 | 9/1978 | Napier | 52/233 |
| 4,250,677 | 2/1981 | Yablonski . | |
| 4,567,701 | 2/1986 | Biggs et al. | 52/233 |
| 4,735,028 | 7/1988 | Bouchen et al. | 52/561 |

FOREIGN PATENT DOCUMENTS

| | | |
|---|---|---|
| 75780 | 6/1976 | Australia . |
| 2450982 | 5/1975 | Fed. Rep. of Germany . |
| 2643270 | 3/1978 | Fed. Rep. of Germany . |
| 2391332 | 12/1978 | France . |
| 1387502 | 3/1975 | United Kingdom . |
| 2103752 | 2/1983 | United Kingdom . |

*Primary Examiner*—David A. Scherbel
*Assistant Examiner*—Creighton Smith
*Attorney, Agent, or Firm*—Lowe, Price, LeBlanc, Becker & Shur

[57] ABSTRACT

A building wall system comprises spaced, parallel exterior and interior walls formed from elongated stacked wooden beam members having opposite ends received in vertical channels secured to vertical elongate wooden supports extending upwardly from a subfloor or bottom plate. Upper end portions of the vertical supports are connected together by a top connecting chord extending between the exterior and interior walls. A top plate is secured to uppermost stacked beams to complete the wall structure. A space defined between the top plate and top chord located therebelow allows for settlement of the stacked wooden exterior and interior beams to occur after constructions without the top plate descending into destructive contact with the top connecting chord. The channels are either straight or ribbed channels and wooden connecting structures connected to allowing for settling of the stacked wooden beams are also disclosed.

31 Claims, 3 Drawing Sheets

BUILDING STRUCTURE HAVING STACKED WOODEN BEAM WALLS

TECHANICAL FIELD

The present invention relates generally to the construction of walls utilized in single or low multi-level story residential and commercial building and, more particularly, to the construction of walls formed by stacked elongate wooden beams.

BACKGROUND ART

The formation of wall systems from elongate, tongue and groove stacked wooden members is known, as exemplified by U.S. Pat. No. 4,250,677 to Yablonski. However, one of the problems associated with forming stacked wooden beam walls is the use of complex subframe support systems that maintain the wall in a single vertical load bearing plane. To provide the necessary support, the above '677 patent relies upon thick, heavy corner support posts having elaborately shaped sides interfitting with corresponding shaped ends of the beam members. The swelling or shrinking of the ends of these beam members can adversely affect the structural integrity of the wall.

After construction, it is common for the stacked wooden beam members to shrink as a result of drying and this can cause the height of the wall to decrease by several inches with upper ones of the stacked wooden beam members experiencing a greater amount of settling displacement than the lower beam members. It is therefore necessary for any stacked beam supporting sub-frame to accommodate beam settlement without destructive contact between the stacked beam walls and the substrate. It is also necessary to provide for beam settlement in the attachment of structures connected to the stacked beam walls that are stationary in relation to the settling beam.

It is also highly desirable for any wall system to have a high degree of insulation (i.e., a high R factor). Although wood has good insulating value, it would be desirable to have a stacked wooden beam wall structure that allows for easy use of other insulating materials, such as foam insulating sheets, and that also simplifies the formation of interior facing walls preferably without the use of wall board.

It is accordingly an object of the present invention to provide a stacked wooden beam wall system that is sturdily supported by a sub-frame accommodating settlement of the stacked beam members after construction.

Another object of the invention is to provide a stacked beam wall system allowing for rapid and easy construction of corner wall sections and intermediate wall sections.

Still another object of the present invention is to provide a stacked beam wall system having exterior and interior parallel walls each formed of stacked wooden beam members that eliminate the need for interior wall finishing materials (e.g., dry wall) and that allow for easy placement of wiring and plumbing lines between the walls.

Yet another object of the present invention is to provide a stacked beam wall system that is extremely energy efficient and has a high R insulating value.

These and other objects of the present invention will become more apparent during the course of the following detailed description and appended claims.

DISCLOSURE OF THE INVENTION

A building wall system, in accordance with the present invention, comprises a support sub-frame including a pair of generally vertical wooden supports having lower ends mounted to one of a sub-floor or a bottom plate in spaced, substantially parallel relationship to each other. A top connecting chord extends between to connect upper end portions of the vertical supports at a predetermined height above the sub-floor. A pair of facing channels are respectively secured to the spaced vertical supports to extend in substantially parallel relationship to each other in a generally vertical plane offset from the vertical plane defined below the top chord. A plurality of elongated wooden beam members of generally rectangular cross section extend between the channels in stacked relationship with opposite ends of said beams received in the channels. The stacked wooden beam wall extends to a predetermined height and a top plate is connected to the uppermost stacked beam to define the upper end of the wall. The top plate has a face extending in a direction substantially perpendicular to the plane of the wall and above the top chord in substantially parallel relationship thereto to define a space between an upper surface of the top chord and a lower surface of the top plate. This space enables settlement of the beams and the top plate to occur relative to the subframe by sliding movement of the beam ends in the channels without the top plate settling into destructive contact with the top chord. The top plate is a necessary structural element of the invention to support either roof trusses or a second level of a stacked wooden beam wall generally identical to the first wooden beam wall described above.

The vertical supports are generally rectangular in cross section with their wide faces perpendicular to the wall surface. The channels are mounted to the wide faces preferably along longitudinal vertical edges thereof and the top chord extends adjacent the channels. The width of the top chord and the channel is preferably less than the width of the vertical support so that the channels and top connecting chord extend between longitudinal vertical edges thereof.

The building wall system of the invention preferably comprises an exterior and interior stacked wooden beam wall in channels mounted to the wide face of the vertical support along opposite longitudinal edges thereof, respectively. The top chord extends between the exterior and interior walls. The top plate straddles the walls above the top chord in spaced relationship thereto. Thereby, it is preferred that each channel extend continuously from a position located at or near the bottom plate or sub-floor to a location above the top chord. A sufficient number of beams are then stacked with their ends in the channels to a position above the top chord to provide support and spacing between the top plate secured thereto above the chord.

It is desirable to exert a downward clamping force against the top plate and stacked beams of the exterior and interior walls to minimize the amount of beam settling that will later occur and ensure positive contact between the tongue and groove longitudinal edges of the wooden beam members In accordance with a preferred feature of the present invention, lag bolts extend through holes drilled in the top plate and the space therebelow for threaded engagement with the top chord. The clamping force is transmitted to the top plate and stacked beam members by tightening the lag bolts until the lag heads and flat washers thereon contact the top plate to transmit tightening pressure.

In accordance with another feature of the invention, the lowermost beam of the interior wall may be formed of a plurality of blocks spaced from each other on the bottom plate or sub-floor. These blocks may be secured to the bottom chord extending between the vertical supports within the exterior and interior walls The bottom chord is of a lesser height than the openings to permit wiring and plumbing lines to be inserted between the walls. A notch may be formed in the lower end of vertical support to permit the wire or plumbing lines to extend through the vertical support.

A pair of vertical supports may be secured to each other to have an L-shaped cross section to establish a corner formed by interior and exterior stacked wooden beams having one end thereof received in channels of the L-shaped member.

To enable attachment of a stud wall defining a wall partition and extending perpendicular to the stacked wooden beam walls, a first connecting vertical stud is formed with plural spaced elongate slots receiving lag bolts securing this first stud to the interior stacked beam wall The lag bolts preferably initially extend through upper portions of the slot into threaded clamping contact with the underlying wooden beam. As settlement of the beams occurs, the bolts descend through the slots without transmitting the settling movement of the beams to the first connecting stud. A second connecting stud having notches in juxtaposed alignment with the slots of the first connecting stud may be secured to the latter with the head of the lag bolt movable through the notches as the settlement occurs.

The channels may be either U-shaped straight channels, or ribbed channels wherein one of the channel side walls has an inwardly projecting rib adapted to lockingly engage a transverse groove formed in one of the wide faces of the wooden stacked beams at ends thereof. Pressure plates may also be disposed between the beam ends and one of the channel side walls, in either channel embodiment, to apply a clamping force via an adjustment screw extending along the interior channel bottom wall and through the exterior channel side wall to ensure that all the beam ends reside in a common vertical loading bearing plane for maximum load bearing support.

BEST MODE FOR CARRYING OUT THE INVENTION

Figure 2:
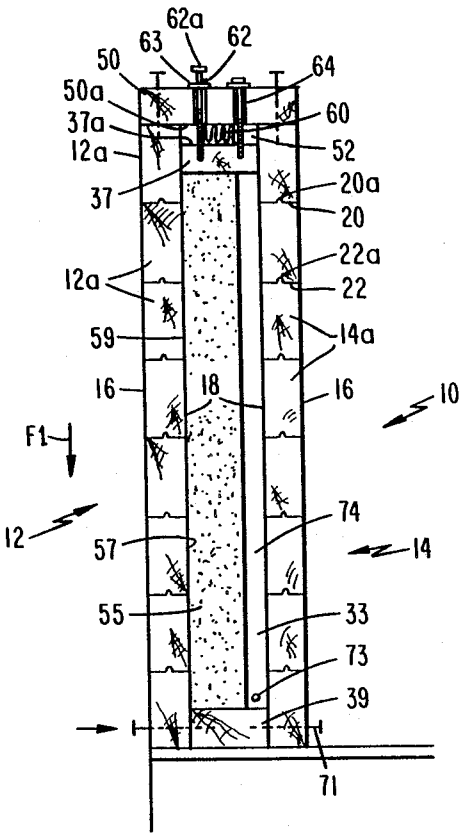
FIG. 2 is a sectional view taken along the line 2—2 of FIG. 1.
Figure 1:
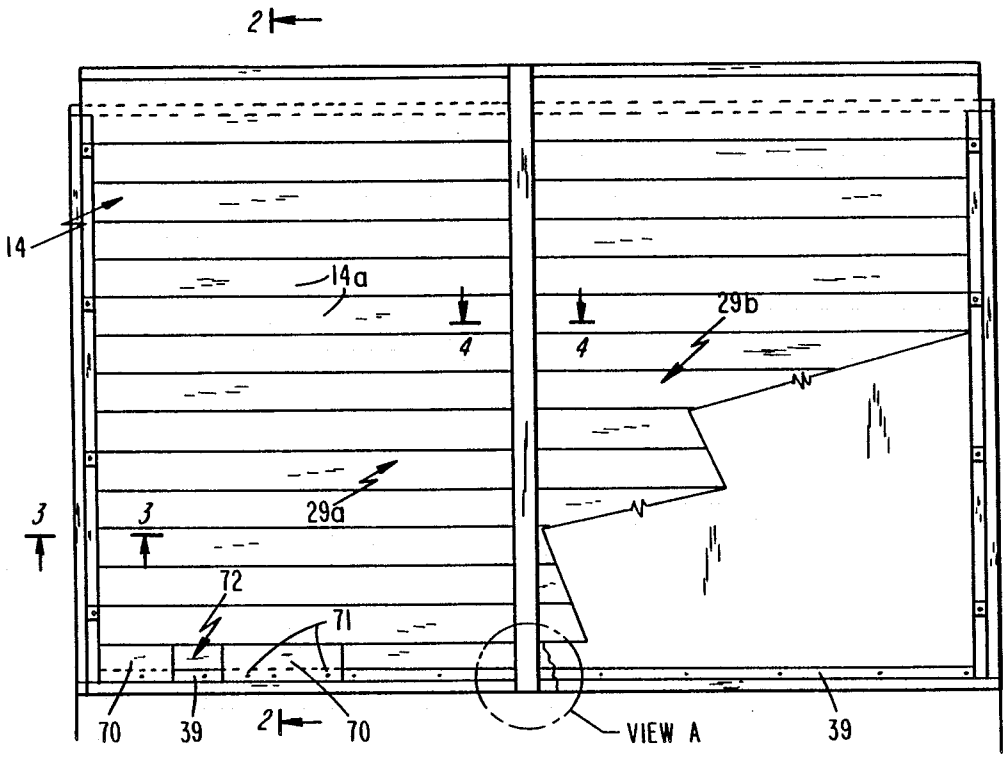
FIG. 1 is a side plan elevational view of a wall system constructed, in accordance with the present claimed invention.

A unique building wall system 10 for use in single and multi-level buildings (e.g., residential, commercial, etc.) comprises an exterior wall 12 and an interior wall 14 respectively formed from a plurality of stacked, substantially identical wooden beams **12*a* and 14*a*, with the walls extending in parallel, spaced relationship to each other In the preferred embodiment, each beam 12*a* and 14*a* may be a 2×6 of rectangular cross section, available in a variety of nominal lengths (e.g., 10 feet, 12 feet, 16 feet, etc.). The exterior beams 12*a* are preferably pressuretreated lumber, whereas the interior beams 14*a* may be either pressure-treated or untreated lumber. Each beam 12*a* and 14*a* has parallel wide faces 16 and 18 and narrower longitudinally extending faces or edges 20 and 22. The edges 20 and 22 are respectively formed with a continuous longitudinally extending tongue 20*a* and groove 22*a* of corresponding cross section with each other to interfit with the tongue or groove of the overlying or underlying stacked beam as depicted in FIGS. 1 and 2. The stacked beams 12*a*,14*a* each have opposite ends 24 received within vertically extending straight wall guide channels 25 (FIG. 3) or ribbed wall guide channels 27 (FIG. 4) mounted, in the unique manner described below, to form either connected, straight wall sections 29*a* and 29*b* (forming a continuous straight wall as shown in FIG. 1) or corner wall sections 29*a* and 30 (FIG. 3**) having superior insulative and strength characteristics in comparison with conventional stud frame construction.

Figure 3:
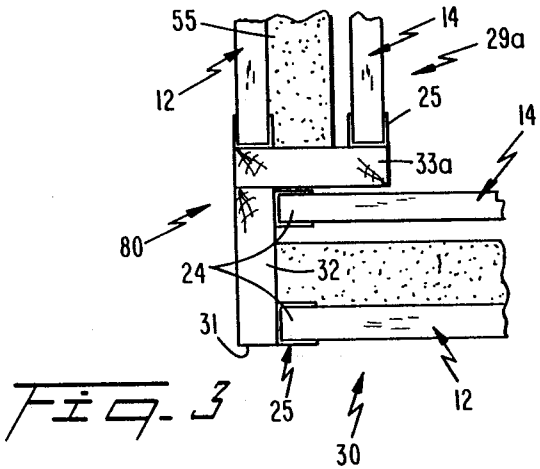
FIG. 3 is a sectional view of a corner portion of the wall system taken along the line 3—3 of FIG. 1.
Figure 4:
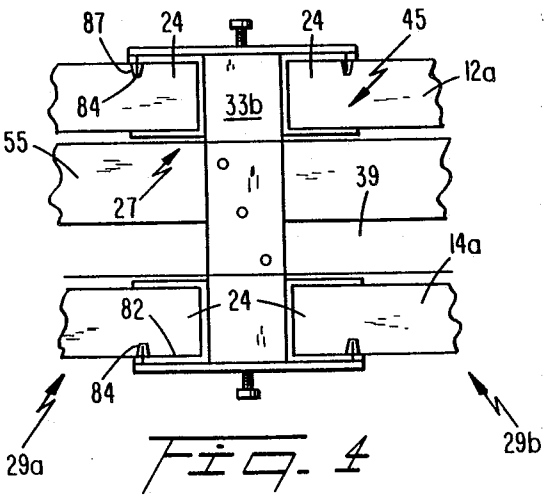
FIG. 4 is a sectional view taken along the line 4—4 of FIG. 1 to depict the manner in which straight wall portions interconnect to form a straight continuous wall wherein ribbed channels extend the full height of the wall.
Figure 6:
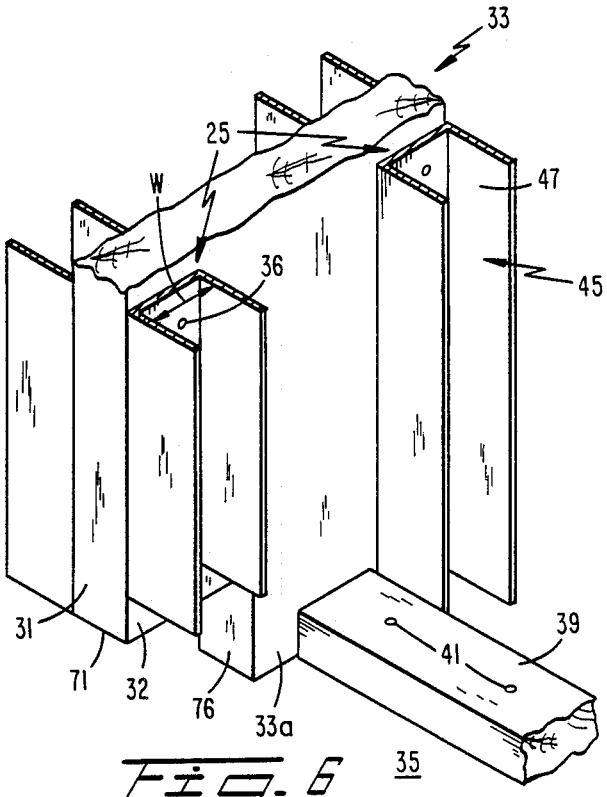
FIG. 6 is a perspective view of the area entitled "View A" of FIG. 1 wherein it is to be understood that the ribbed channels of FIG. 4 are disclosed as straight channels extending the full height of the in substitution for the ribbed channels.

As best depicted in FIGS. 3, 4 and 6, a pair of channels 25 are mounted to a vertical support frame member 33 to respectively extend adjacent its edges 31 and against the wide face 32 thereof. The vertical support 31 is of rectangular cross section and extends the height of the wall. The lower end 33a of vertical support member 33 rests upon and may be secured to a conventional sub-floor or top plate 35. pressure-treated lumber with the channel bottom walls 35 of channel 25 or 27 screwed or nailed as at 36 to the wide faces 32 thereof.

A pair of connected straight wall sections **29*a* and 29*b* as depicted in FIGS. 1 and 6 may be constructed in the following manner. First, a pair of spaced vertical supports 33 are secured in parallel spaced relationship to each other with horizontally extending top and bottom chord members 37 and 39. The top and bottom chords 37,39 are preferably identical to each other and formed of lumber of rectangular cross section (e g., 2×4's when 2×8's are used as vertical supports 33). The chords 37,39 are leg bolted or otherwise secured to the upper and lower ends of supports 33 and spaced inwardly from stacked beams 12*a*,14*a* (see FIGS. 2 and 6), for purposes described hereinafter, to define a rigid, stationary sub-frame. With reference to sections 29*a* and 29*b*, the vertical support at one end of wall section 29*a* has a pair of channels 25 secured to one wide face thereof as depicted in FIG. 3. An intermediate vertical support 33***b* defining part of the sub-frame in both of wall sections 29*a* and 29*b* (FIG. 6) is equipped with a pair of channels 25 on each wide face thereof. The bottom connecting chord 39 with its wide face in contact with the sub-floor or bottom plate is screwed or nailed thereto as at 41.

The exterior wall 12 may then be constructed by inserting the opposite ends 24 of each exterior beam 12a into the wall guide channels in one of two ways. With the U-shaped channels 25 of FIG. 3, for example, the opposite ends 24 of each exterior beam 12*a* may be inserted into the respective channels by inserting the opposite ends into the channel through the top open end 43 thereof (e.g., FIG. 5) and sliding the ends downwardly through the channels until they abut the sub-floor or plate 35 or the previously stacked beam so as to obtain the aligned, tongue-and-groove interfitting stacked beam relationship depicted in FIG. 2. Alternatively, since the wooden beam tends to be flexible, it may be possible to insert one end 24 of an exterior beam 12*a* into the open side end 45 of the channel slightly above its stacked elevational location (i.e., to clear the upward facing tongue 20*a* of the previously stacked beam 12*a*) and then inserting the other end of the beam into its corresponding channel by slightly flexing the beam so that the end clears the outward facing channel side wall 47 to enter the channel. By releasing flexing pressure, the beam 12a straightens and then slides a short distance into its final stacked position, whereby its downward facing groove 22*a* interfits with tongue 20*a* of the previously stacked beam. Preferably, however, the beams are cut slightly shorter than the distance between opposing channel bottoms so that the beam can be tilted and angled into proper position In accordance with a unique feature of the present invention, the top connecting chord 37 is secured at its opposite ends to the vertical supports at a position which is located a predetermined distance below the uppermost edge of the topmost stacked beam as depicted in FIG. 2. Alternatively, depending upon the size of the wall being constructed, the top chord 37 may span the top edge of the support 33 and be secured thereto with lags, nails, etc. Since the beams of the interior wall are located at common elevational positions with the exterior beams, the wall construction is completed by securing a top plate 50 to the topmost beams 12*a*' and 14*a*', with nails or the like. The spacing 52 thereby defined between the upper surface 37*a* of the top chord 37 and the lower surface 50*a* of the top plate 50 is a highly preferred feature since the exterior and interior stacked beams 12*a*,14*a* will settle after construction (primarily as a result of drying). Since the top connecting chord 37 is secured to the vertical supports 33*a*,33*b* to form a stationary support sub-frame structure that does not settle, the spacing 52 is somewhat critical to allow the walls to settle without causing the top plate 50 to descend into destructive contact with the top connecting chord 37 that might otherwise buckle or bow the walls.

The top connecting chords 37 extending respectively between adjacent vertical supports 33*a*,33*b* (or a single long chord extending between non-adjacent supports and spanning an intermediate support as mentioned above) in the manner described above are necessary to maintain the constant parallel spacing between the channels 25 receiving opposite ends 24 of the same beam. Otherwise, it is possible for the vertical supports 33*a*,33*b* to move slightly out of parallel relationship with each other, disadvantageously causing the ends 24 of the stacked beams 12*a*,14*a* to disengage from the channel 25 that would destroy the structural integrity and aesthetic appearance of either the exterior and/or interior wall 12,14. Additionally, to improve rigidity, diagonal bracing 33' extends between channels 25 for attachment to vertical support 33*a* and bottom chord 39.

It is another preferred feature of the invention to apply a downward clamping force Fl against the walls 12,14 to ensure positive contact between the stacked beams along the length of the walls and minimize the amount of settlement that will later occur. This clamping force is accomplished by inserting a pair of lag bolts 62 through holes 64 drilled through top plate 50sothat the threaded ends of the bolts pass through space 52 into threaded engagement with top chord 37. Since the top chord 37 is a part of the rigid sub-frame and thereby substantially vertically immovable, the lag bolts 62 are torqued down until their heads 62*a* and washers 63 rest upon the upper surface of top plate 50. The bolts 62 are not in threaded contact with the top plate 50. Thereby, further tightening pressure applied to top chord 37 through bolts 62 transmit clamping face Fl to the stacked beams 12*a*,14*a*. In the event additional settlement subsequently occurs, additional space 52 is available to allow top plate 50 to descend toward top chord 37 since holes 64 are of sufficient diameter to permit sliding movement of bolts 62 through the holes into the raised position of the left hand bolt in FIG. 2. If an additional story is being built upon top plate 50 (that would then function as a bottom plate), clearance holes is alignment with lags 62 may be provided in the bottom chord 37 (not shown) to be secured to upper surfaces of the top plate 50. These clearance holes receive the lag bolt 62 in the raised position and, by forming the clearance holes with sufficient diameter, the bolts 62 may be torqued down at a later time by access thereto from the upper story.

As mentioned briefly above, the top plate 50 of FIG. 2 can now function as a sub-floor or bottom plate 35 to allow a second story of exterior and interior stacked beams 12*a*,14*a* to be built upon the first story of wall system 10 depicted in FIG. 2. The second story may have the identical construction depicted in FIG. 2.

Following completion of the exterior wall 12 forming either wall sections 29*a*, 29*b* or 30 in the manner described above, sheets of foam insulation 55 may be glued to the inner surface 57 of the exterior stacked beams 12*a* for improved insulation. Because the beams 12*a* will settle, with the upper beams 12*a*' experiencing a greater degree of settlement than the lowermost beams, it is, preferred to secure the foam insulation sheets 55 to the beams with horizontal beads of glue and preferably only with a single bead 59 of glue applied to one of the uppermost exterior beams. Insulation 60, such as fiberglass flexible strips, rock wool, etc., may also be advantageously provided in the space 52 between the top plate 50 and top connecting chord 37.

The interior wall 14 is preferably constructed in the following manner First, blocks 70 of lumber are positioned in spaced apart relationship from each other atop the bottom plate or sub-floor 35 along a line extending between a pair of facing interior channels 25. These blocks 70 are nailed at 71 to the bottom connecting chord 39 extending between the vertical supports 33a,33b and define spaced openings 72 to facilitate the easy placement of wiring 73 or plumbing that will extend within the air space 74 located between the foam insulation 55 and the inner stacked beams 14a. These bottom supporting blocks 70 and openings 72 therebetween will ultimately be concealed with trim baseboard material (not shown). Thereafter, the interior beams 14a are stacked on top of each other in the manner described above for the exterior beams 12a.

The intermediate vertical support 33b connecting the straight wall sections 29a,29b together preferably includes a notch 76 (FIG. 6) at its lower, interior end 77 to allow plumbing or the wiring 73 to traverse the intermediate vertical support in an uninterrupted manner.

Corner wall sections 29a and 30 are preferably formed in the manner depicted in FIG. 3 wherein the corner vertical supports 33a,33b are secured to each other to define a vertical supporting member 80 of L-shaped cross section. One wide face 32 of each corner vertical support 33a carries a pair of channel guides 25 receiving exterior and interior stacked beams 12a and 14a, respectively, in the manner described above.

Figure 5:
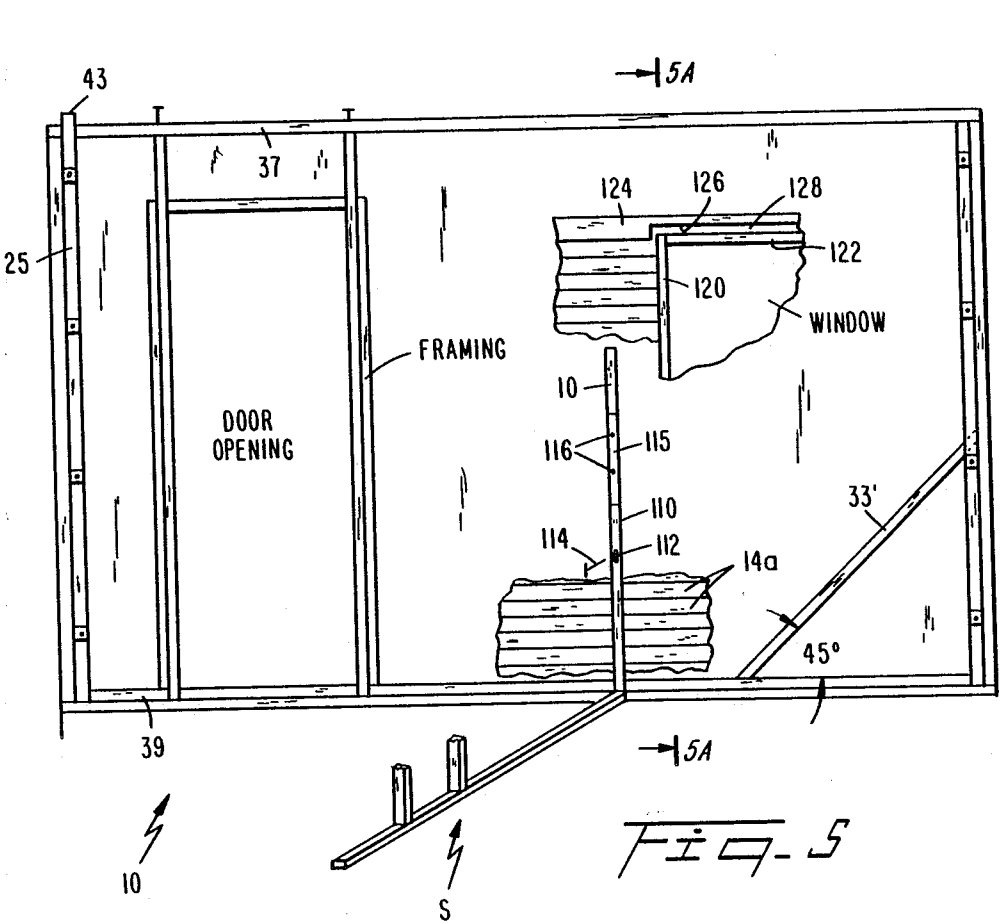
FIG. 5 is a plan elevational view depicting various features of the invention and the sub-frame to which the stacked wooden beam members are secured in movable relation thereto.

FIG. 5 is an illustration as to a preferred structure for securing a conventional stud wall S (e.g., an interior room partition) to the stacked wooden beams 14a of interior wall 14 (or to the exterior stacked wooden beams 12a of exterior wall 12 if wall system 10 is formed only with an exterior wall as deemed within the scope of the present invention). To secure interior stud walls to the stacked wooden beams 12a or 14a, a vertical first connecting stud is formed with longitudinal slots 112 in the wide face thereof extending through the depth of the stud. A lag bolt and washer 114 is then inserted through the slot 112 and in an upper portion thereof and tightened sufficiently so as to exert a clamping force securing the connecting stud 110 to the stacked beams 12a or 14a. A second stud 115 depicted in partial cut away view in FIG. 5 may then be secured to the first connecting stud 110 with nails 116 and the like (that do not penetrate beams 12a or 14a) to form a connecting post of double thickness to which the interior stud wall S may now be secured. The wide surface of the second stud 115 facing the slotted first connecting stud 110 preferably includes notches (not shown) in respective juxtaposed alignment with the slots 112. The notches receive the heads of the lag bolts 114. With this unique structure, as the wooden beams 12a or 14a settle in the manner described above, the lag bolts 114 threadedly connected to an underlying wooden beam 12a or 14a descends through the slot 112 (with the head of the lag bolt descending through the notch of the second stud 115) advantageously without transmitting settlement forces to the interior stud wall S.

Figure 5A:
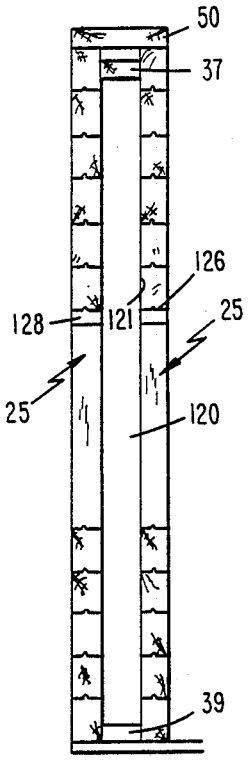
FIG. 5A,is a sectional view taken along the line 5A—5A of FIG. 5.

Window openings may be within wall system 10 with a vertical support 120 having substantially the same width characteristics as vertical supports 33 but formed with cutouts 121 above and below the window opening along which the exterior and interior stacked beams 12a,14a extend continuously from an adjacent vertical support 33 to another vertical support located on the opposite side of the window (not shown). In the non-cutout portions of support 120 extending elevationally adjacent the window opening, short pieces of channels 25 or 27 are secured to outer surfaces of the non-cutout portions facing outwardly from the window opening. These short channel sections receive opposite ends of the stacked wooden beams located elevationally between upper and lower ends of the window opening in vertical alignment with the remainder of the stacked beam walls. Note that one of the interior and exterior wooden beams 124 extending continuously along the top horizontal framing member 122 of the window may be notched at 126 to define a settlement space 128 that prevents this beam from destructively contacting the window framing after settlement occurs In FIG. 5A the beams extending elevationally adjacent the window openings within the short channels 25 are omitted for clarity.

The door opening may be framed in the same manner as the window opening described above.

FIG. 4 is an illustration of an alternative embodiment of the U-shaped channels 25 of FIG. 3 wherein a channel 27 has one of its channel side walls 82 formed with a rib 84 at a free end thereof projecting a slight distance into the channel area In this embodiment, a groove 87 is formed in one wide face at each end 24 of the stacked beams 12a,14a to interlock with the rib 84 and thereby prevent withdrawal of the beam end from the channel 27 during longitudinal shrinking of the beam when drying. The groove 87 intersects the narrow faces or edges 20,22 of each beam 12a,14a to permit the beam ends 24 to be dropped into the top open ends 43 of the channel to slide therealong, in interfitting engagement with the ribs 84, into stacked position The primary advantage of ribbed channels 27, however, is that of providing the same rigidity that top chord 37 provides when straight channels 25 are used. In other words, ribbed channels 27 may be used to form walls 12,14 without the vertical supports and top and bottom connecting chords, since the ribs retain beam ends 24 within their respective channels. Of course, ribbed channels 27 can be used in substitution for channels 25 (i.e., in combination with the vertical support and connecting chords as depicted in FIG. 4) for improved rigidity.

The width 89 (FIG. 7) of the transverse grooves 87 respectively formed in the beam ends 24 is preferably slightly larger than the corresponding width of the rib 84 to facilitate smooth sliding movement therebetween during stacking and to provide some degree of spacing to prevent the rib from crushing against one of the groove side walls 87a during shrinking or expansion of the beam 12a,14a.

The wall ribbed guide channels 27 of FIG. 4 may be used in substitution for or in combination with the straight wall guide channels 25 of FIG. 3. However, in the event the ribbed wall guide channels 27 of FIG. 4 are used exclusively as interior and exterior channels between a pair of adjacent vertical supports 33a,33b, it is not necessary to form a rigid sub-frame by lagging or securing the top and bottom horizontal connecting chords 37,39 to the vertical supports in the manner described above since the ribs interlock with the beam ends 24 to prevent withdrawal from the channels. For improved rigidity, however, it is preferred to utilize the rigid sub-frame of the invention comprising the adjacent vertical supports and at least the top connecting chord, irrespective of which channel wall guide is used in construction. However, it is a preferred feature of the present invention to use the sub-frame of the invention as described above, with wall guide channels 25 of FIG. 3 to construct the exterior beam wall 12 and the ribbed channels 27 of FIG. 4 used to form the interior wall 14, since the straight non-ribbed channels of FIG. 3 facilitate construction of the exterior wall 12 by allowing the ends of each stacked beam 12a to be inserted into the open channel in sideways direction 45 (by tilting and angling the beam in the manner described supra) without requiring each stacked beam to be dropped into its final position through the top open end 43 of the channel.

Figure 7:
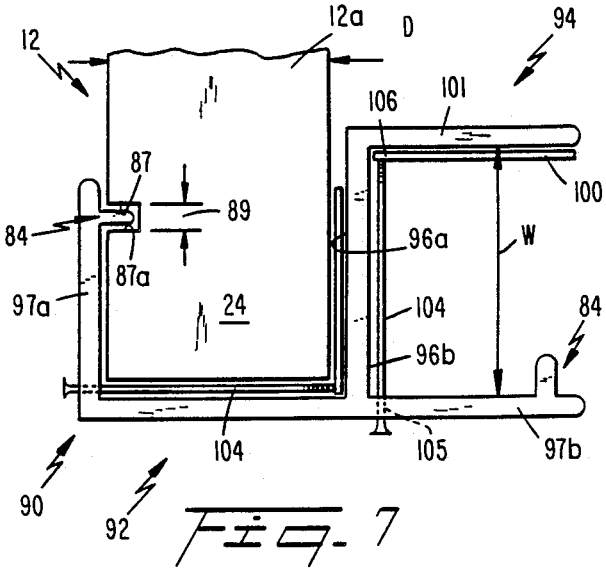
FIG. 7 is a top plan view of another feature of the present invention.

Although the ribbed wall guide channels 27 of FIG. 4 may be utilized in forming the connected straight wall sections *29a,29b* of FIGS. 4 and 6 or the corner section 30 of FIG. 3 (in substitution for the non-ribbed channels), FIG. 7 is an illustration of a corner bracket 90 in accordance with the present invention wherein mutually perpendicular channel sections 92 and 94 are formed with a common wall 96 therebetween defining an interior side *96a* of one channel section 92 and the bottom *96b* of the second channel section 94. Exterior walls *97a,97b* of the first and second channel sections 92,94 are ribbed at 84 in the manner described supra. To construct a corner wall section 30 with corner bracket 90, the corner bracket of FIG. 7 would be secured to the bottom plate or sub-floor 35 using conventional angle brackets (not shown) fixed to the lower end thereof. Exterior wood beams *12a* would then be dropped into the first and second channel sections 92 and 94 in stacked relationship to form the exterior walls of corner wall sections *29a* and 30, respectively. A second identical corner bracket 90 (not shown in detail) would then be fixed to the sub-floor or bottom plate 35 diagonally adjacent and spaced from the exterior corner bracket to form the interior walls 14 of corner wall sections *29a* and 30 (not shown in detail).

Figure 8:
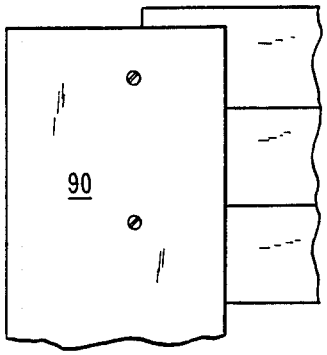
FIG. 8 is a side elevational view of the embodiment of FIG. 7.

It will be apparent that the width W of the straight or ribbed channel wall guides 25,27 measured between the side walls thereof is greater than the corresponding width of wooden beams *12a* or *14a* to facilitate either smooth sliding through, or straight insertion of the ends into the channel. To prevent the beam ends 24 from popping out, of the straight channel wall guides 25 in the event an inadvertent force is applied against the wide faces of either the interior or exterior beams *12a,14a,* or to compensate for the variation in board thickness when either the straight or ribbed channels are used, a pressure plate 100 may be provided along the inner surface of an inner channel side for clamping engagement against the beam ends. As depicted in FIGS. 7 and 8, for example, the pressure plate is preferably a thin rigid plate (e.g., of hardened steel) of rectangular configuration that may extend the full length of the channel wall guide 25 or 27. The width of the pressure plate 100 is preferably less than or equal to the height of the channel side 101 against which it abuts. An adjustment screw 104 extends through the outward facing channel side *97a* or *97b* through an unthreaded hole 105 for threaded contact with a hole 106 in the pressure plate 100. The bottom of the screw 104 bears against the inner surface of the inner channel side 101 so that upon rotation of the adjustment screw, the pressure plate 100 advances inwardly into the channel along the threaded screw end to bear against the beam end 24 in clamping contact. The adjustment screw 104 is located to extend immediately adjacent the channel bottom to avoid contact with the beam end 24.

The pressure plate/adjustment screw arrangement described above may be used in conjunction with either the ribbed or straight channel wall guides 25,27 or 90 disclosed above. The pressure plate 100 clamped against the beam ends assures that the stacked beams *12a* or *14a* lie in a common load bearing plane for maximum strength and rigidity.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

I claim:

1. A building wall, comprising:

(a) a support sub-frame including a pair of generally vertical wooden supports having lower ends mounted to one of a sub-floor or a bottom plate in spaced apart substantially parallel relationship to each other and a top connecting chord extending between and connected to upper end portions of the vertical supports at a predetermined height above the sub-floor or top plate;

(b) a pair of facing channels respectively secured to the vertical supports to extend in substantially parallel relationship to each other in a generally vertical plane offset from the vertical plane defined below the top chord;

(c) a plurality of elongated wooden beam members of generally rectangular cross section extending between the channels in stacked relationship to another predetermined height with opposite ends of said beams received in said channel;

(d) a top plate connected to the uppermost stacked beam to define the upper end of the wall, the top plate having a face extending in a direction substantially perpendicular to the wall above the top chord in substantially parallel relationship thereto to define a space between an upper surface of the top chord and a lower surface of the top plate;

whereby said space enables settlement of said beams and top plate to occur relative to the sub-frame by sliding movement of the beam ends downwardly through the channels without said top plate settling into destructive contact with the top chord.

2. The building wall of claim 1, whereby said vertical supports are generally rectangular in cross section with their wide faces extending perpendicular to the wall, said wide faces having a width W, said channels mounted to the wide face having a width Wl, said top chord having a width W2 extending between the wide faces of the vertical supports and intermediate the long vertical edges or faces of said supports, wherein Wl+W2 is $\leqq$W.

3. The building wall of claim 2, wherein an exterior and an interior stacked wooden beam wall is provided within a pair of channels respectively mounted to the wide face of the vertical supports along opposite longitudinal edges thereof, said top chord extending between the interior and exterior walls, the top plate extending above the top chord with opposite edges of the wide face of the top plate being fastened to uppermost beams of the interior and exterior walls and spaced above the top chord.

4. The building wall of claim 3, further including clamping means connected to the top chord for applying a downward clamping force against the top plate and stacked beams, said clamping means including lag screws and the like extending through unthreaded holes formed in the top plate, said screws only having threaded contact with the top chord, whereby tightening of said screws exerts the downward clamping force against the top plate and stacked beams.

5. The building wall of claim 4, further including insulation attached to an interior surface of the exterior stacked beams, said insulation having a thickness defining a space between the insulation and the interior stacked beams through which space wiring and plumbing lines may extend.

6. The building wall of claim 5, wherein a lowermost beam of said interior wall is a plurality of wooden blocks spaced from each other between opposing channels to define openings permitting wiring and plumbing to be inserted between the walls.

7. The building wall of claim 3, wherein a building wall corner is formed by a pair of vertical supports secured to each other to have an L-shaped cross section, a wide face of one of the supports facing away from an interior corner of the L carrying channels for defining one of the wall sections forming the corner and wherein a wide face of the other support carries channels for defining the other wall section of the corner which second wall is generally perpendicular to the first wall with the interior wall of the second wall extending along the opposite wide face of the first support.

8. The building wall of claim 6, further including a bottom chord fastened to the bottom plate between the interior and exterior walls and extending between the vertical supports, wherein the bottommost beams of the exterior and interior walls are secured to the bottom chord, the height of said bottom chord being less than the height of the lowermost interior beam so as not to obstruct said openings.

9. The building wall of claim 1, further comprising a first connecting vertical stud mounted to the beams to support an interior stud wall and the like adapted to extend perpendicular to the stacked beam wall, said first connecting stud having plural spaced elongate slots extending through a wide face thereof along its length, screw means extending through an upper portion of each slot into threaded clamping contact with the wooden beams, whereby settlement of said beams after construction enables the screw means to descend through the slots without transmitting the settling movement of the beams to the first connecting stud and interior wall attached thereto.

10. The building wall of claim 9, further including a second connecting stud adapted to be fastened to the first connecting stud to define a mounting post of double thickness for the interior stud wall, wherein a wide face of the second connecting stud adapted to contact the exposed wide face of the first connecting stud is formed with notches adapted to be positioned in juxtaposed alignment with the slots, said notches thereby receiving screw heads of the screw means enabling the screw means to descend through the slots.

11. The building wall of claim 1, wherein said building wall includes a horizontal framing means defining an upper end of one of a window frame or door frame, and wherein a stacked beams extending immediately adjacent thereabove the horizontal framing member defines a space to allow said beam to settle without destructively contacting one of a door jamb or window casement.

12. The building wall of claim 3, wherein said channels are straight channels.

13. The building wall of claim 3, wherein said channels are ribbed channels.

14. The building wall of claim 1, wherein said opposite ends of said wooden beam members are received in said channels without being connected to the channels with fasteners, said beams thereby being freely floating in relation to the channels and capable of said sliding movement.

15. The building wall of claim 3, wherein a building wall corner is formed by a pair of vertical supports secured to each other to have an L-shaped cross section, a wide face of one of the supports facing away from an interior corner of the L carrying channels for defining a first one of the wall sections forming the corner and wherein a wide face of the other support carries at least one channel for defining a second wall section of the corner which second wall is generally perpendicular to the first wall.

16. A wall, comprising:

(a) a plurality of elongated beam members of generally rectangular cross-section with front and back faces terminating in opposite ends, said faces being generally parallel to each other to define the thickness D of the beam;

(b) connector means for supporting a stack of said beam members one atop another, said connector means including a bracket formed with a channel extending generally vertically to receive one end of each stacked beam, said channel including first and second generally parallel walls joined by a base all, said first and second walls defining channel width W substantially constant along substantially the entire length of said channel, and where D S W such that the ends of some of said beam members are capable of transverse loose movement between the channel walls in a direction orthogonal to the plane of the wall and are thereby loosely mounted within the channel; and (c) means for preventing transverse movement of said beam members within the channel by applying a substantially uniform force or pressure to one of the front and back faces proximate the ends of said beam members to thereby urge said beam members against the channel wall facing the other of the front and back faces.

17. The wall of claim 16 wherein said movement preventing means includes pressure plate means positioned between one of the front and back faces and the associated first or second channel wall, and means extending through one of the first and second channel walls for moving the pressure plate means in the transverse direction.

18. The wall of claim 17, wherein said pressure plate means includes a plate of rectangular crosssection in plan view having a length generally corresponding to the channel length and a thickness less than (W minus D), said plate moving means including an adjustment screw connected to move the plate in the transverse direction.

19. The wall of claim 18 wherein the width of the pressure plate is less than the height of the associated channel wall as measured relative to the channel base wall.

20. The wall of claim 18, wherein said pressure plate is located between the second or rear channel wall and the back face of the beams, said adjustment screw extending through the first or front channel wall and generally parallel to the channel base wall in a space formed between the base wall and ends of the beam members to threadedly engage the pressure plate.

21. The wall of claim 20, wherein said adjustment screw is unthreaded along its shank except at its distal end threadedly engaging and passing through a threaded opening in the pressure plate.

22. The wall of claim 21 wherein said distal end of the adjustment screw is blunt and bears against the interior surface of the rear channel wall.

23. The wall of claim 22, wherein said adjustment screw includes a screw head located outwardly adjacent the front channel wall.

24. The wall of claim 23 further including a plurality of said adjustment screws vertically spaced along the front channel wall to apply uniform tightening pressure to substantially each of said beam members.

25. The wall of claim 18, wherein said pressure plate means is located between the front face of the beam members and the front or first channel wall, said adjustment screw engaging the plate.

26. The wall of claim 18 wherein each beam member has a groove defined extending depthwise into said front surface and extending entirely across the width of said beam member at a location spaced from said first end by a relatively short portion of said length dimension, and said bracket further includes a rib having a base portion integral with said first wall and a distal end projecting into said channel from said first wall, said rib extending substantially the entire length of said channel at a location to be received in said groove in each of the supported beam members.

27. The wall of claim 16 wherein said bracket further includes wall means defining a second channel, said second channel having a first wall defined by the base wall of the first channel and a second wall extending generally parallel to the base wall and joined thereto by a second base wall such that said second channel enables stacking of ends of beam members to define a second wall extending perpendicular to the first wall, and means for preventing transverse movement of said beam members having ends located within the second channel by applying a substantially uniform force or pressure to one of the front and back faces proximate to the ends of said beam members in the second channel to thereby urge each of said beam members against the channel wall facing the other of the front and back faces of the beam members in the second channel.

28. The wall of claim 27 wherein each beam member in the second channel has a groove defined depthwise into said front surface and extending entirely across the width of said beam member at a location spaced from said first end by a relatively short portion of said length dimension, said bracket further including a rib having a base portion integral with the first wall of the second channel and said rib further including a distal end projecting into said second channel from said first wall, said rib extending substantially the entire length of said channel at a location to a received in said groove in each of the supported beam members in the second channel.

29. A wall, comprising:

(a) a plurality of elongated beam members of generally rectangular cross-section with front and back faces terminating in opposite ends, said faces being generally parallel to each other to define the thickness D of the beam;

(b) connector means for supporting a stack of said beam members one atop another, said connector means including a bracket formed with a channel extending generally vertically to receive one end of each stacked beam, said channel including first and second generally parallel walls joined by a base wall, said first and second walls defining a channel width W substantially constant along substantially the entire length of said channel, and where D S W such that the ends of some of said beam members are capable of transverse loose movement between the channel walls in a direction orthogonal to the plane of the wall and are thereby loosely mounted within the channel, each beam member having a groove defined depthwise into said front surface and extending entirely across the width of said front surface and extending entirely across the width of said beam member at a location spaced from said first end by a relatively short portion of said length dimension, and wherein said bracket further includes a rib having a base portion engaging with said first or front channel wall and said rib further includes a distal end projecting into said channel from said base portion, said rib extending substantially the entire length of said channel at a location to be received in said groove in each of the supported beam members;

(c) means for preventing transverse movement of said beam members within the channel by applying a substantially uniform force or pressure to one of the front and back faces proximate the ends of said beam members to thereby urge said beam members against the channel wall facing the other of the front and back faces, said movement preventing means being means for moving said rib in a direction perpendicular to the plane of said wall.

30. In combination:

a plurality of elongated wooden beam members with length, width and depth dimensions and having first and second long edges extending in said length and depth dimensions, front and back surfaces extending in said length and width dimensions, and first and second ends extending in said width and depth dimensions, each beam member having a groove defined with opposite substantially parallel sides extending depth-wise into said front surface and extending entirely across the width of said beam member at a location spaced from said first end by a relatively short portion of said length dimension; and connector means for supporting a stack of said beam members one atop the other with the second long edge of successively stacked beam members facing downward and bearing directly against the upwardly facing first long edge of a lower beam member, said connector means comprising a bracket defining an open-sided channel elongated vertically in the width dimension of said supported beam members and configured to receive said first end of all of said stacked beam members, said channel including first and second mutually parallel spaced walls joined by a base wall and disposed such that first and second channel walls are adjacent the front and back surfaces, respectively, of the received beam members and said base wall is adjacent the first ends of the received beam members, and wherein said bracket further includes a rib having a base portion integral with said first wall and a distal end projecting into said channel from said first wall, said rib extending substantially the entire length of said channel at a location to be received in said groove in each of the support beam members, said rib having a tapered configuration such that it is wider at said web portion than at said distal end, the width of said base portion being substantially equal to the spacing between said sides of said groove.

31. A building wall comprising a support sub-frame including at least a pair of supports having lower ends mounted to one of a sub-floor or a bottom plate and spaced apart in substantially parallel relationship to each other and means extending between and connected to upper end portions of the vertical supports at a predetermined height above the sub-floor or bottom plate; said supports including channel means extending the length of said supports; a plurality of elongated beam members of generally rectangular cross section extending between the channel means in stacked relationship with opposite ends of said beams received in said channel means, said beams thereby being retained by said channels in a plane extending coplanar with the channel means; wherein said opposite ends of said beam members are received in said channels without being connected to the channels with fasteners, said beams thereby being freely floating in relation to the channels and capable of sliding movement when settlement of said beams occurs relative to the sub-frame.

* * * * *